United States Patent [19]

Pfeifer et al.

[11] 4,314,594

[45] Feb. 9, 1982

[54] REDUCING MAGNETIC HYSTERESIS LOSSES IN CORES OF THIN TAPES OF SOFT MAGNETIC AMORPHOUS METAL ALLOYS

[75] Inventors: Friedrich Pfeifer, Bruchköbel; Wernfried Behnke, Hanau, both of Fed. Rep. of Germany

[73] Assignee: Vacuumschmelze GmbH, Fed. Rep. of Germany

[21] Appl. No.: 144,895

[22] Filed: Apr. 29, 1980

Related U.S. Application Data

[63] Continuation-in-part of Ser. No. 881,039, Feb. 24, 1978, abandoned.

[30] Foreign Application Priority Data

Feb. 26, 1977 [DE] Fed. Rep. of Germany ..... 2708472
Mar. 5, 1977 [DE] Fed. Rep. of Germany ..... 2709626

[51] Int. Cl.[3] ..... C21D 1/04; H01F 3/04

[52] U.S. Cl. ..... 148/108; 148/6.3; 148/31.5; 148/31.55; 148/122; 428/606; 428/629; 428/928

[58] Field of Search ..... 75/126 R, 126 H, 126 P, 75/126 K, 126 Q, 126 J, 134 R, 134 F, 134 S, 134 P; 148/101, 103, 108, 120, 121, 722, 6.3, 6.31, 6.35, 31.55, 31.5, 31.57; 428/606, 607, 629, 632, 928, 633

[56] References Cited

U.S. PATENT DOCUMENTS

| | | | |
|---|---|---|---|
| 2,988,466 | 6/1961 | Meiklejohn | 148/6.3 |
| 3,961,990 | 6/1976 | Koester et al. | 148/6.3 |
| 3,986,867 | 10/1976 | Masumoto et al. | 75/126 A |
| 4,036,638 | 7/1977 | Ray et al. | 148/31.55 |
| 4,053,331 | 10/1977 | Graham, Jr. et al. | 148/31.55 |
| 4,053,332 | 10/1977 | Egami et al. | 75/134 F |
| 4,067,732 | 1/1978 | Ray | 75/126 P |
| 4,079,430 | 3/1978 | Fujishima et al. | 360/126 |
| 4,081,298 | 3/1978 | Mendelsohn | 148/122 |

FOREIGN PATENT DOCUMENTS

| | | | |
|---|---|---|---|
| 2500846 | 10/1975 | Fed. Rep. of Germany . | |
| 2546676 | 4/1976 | Fed. Rep. of Germany . | |
| 2553003 | 8/1976 | Fed. Rep. of Germany . | |
| 2605615 | 9/1976 | Fed. Rep. of Germany . | |
| 2606581 | 9/1976 | Fed. Rep. of Germany . | |
| 2628362 | 1/1977 | Fed. Rep. of Germany . | |
| 2709626 | 9/1978 | Fed. Rep. of Germany | 148/121 |
| 51-73923 | 6/1976 | Japan | 148/108 |

OTHER PUBLICATIONS

Kubaschewski, O. et al., *Oxrdation of Metals and Alloys*, Academic Press, London, p. 1, (1962).

Luborsky, F. et al., "Magnetic Annealing of Amorphous Alloys", *IEEE Transactions on Magnetics*, vol. Mag-11, No. 6, pp. 1644-1649 (11/75).

Luborsky, F. et. al., "Magnetic Annealing of Amorphous Alloy Toroids", *Rapidly Quenched Metals*, vol. 1, Boston, pp. 1-6 (1975).

*Primary Examiner*—Michael L. Lewis

*Attorney, Agent, or Firm*—Hill, Van Santen, Steadman, Chiara & Simpson

[57] ABSTRACT

A technique for processing thin tapes of soft magnetic amorphous metal alloys to reduce their magnetic hysteresis losses. The technique involves preliminarily forming such a tape into a core, heating the core, and then controllably cooling the core, the heating and cooling being conducted in an oxidizing atmosphere. Maintaining the core during processing in a suitable longitudinal or transverse (relative to the tape) magnetic field can also produce improved properties. Certain tape cores so processed have particular magnetic hysteresis loss characteristics never heretofore known.

23 Claims, 1 Drawing Figure

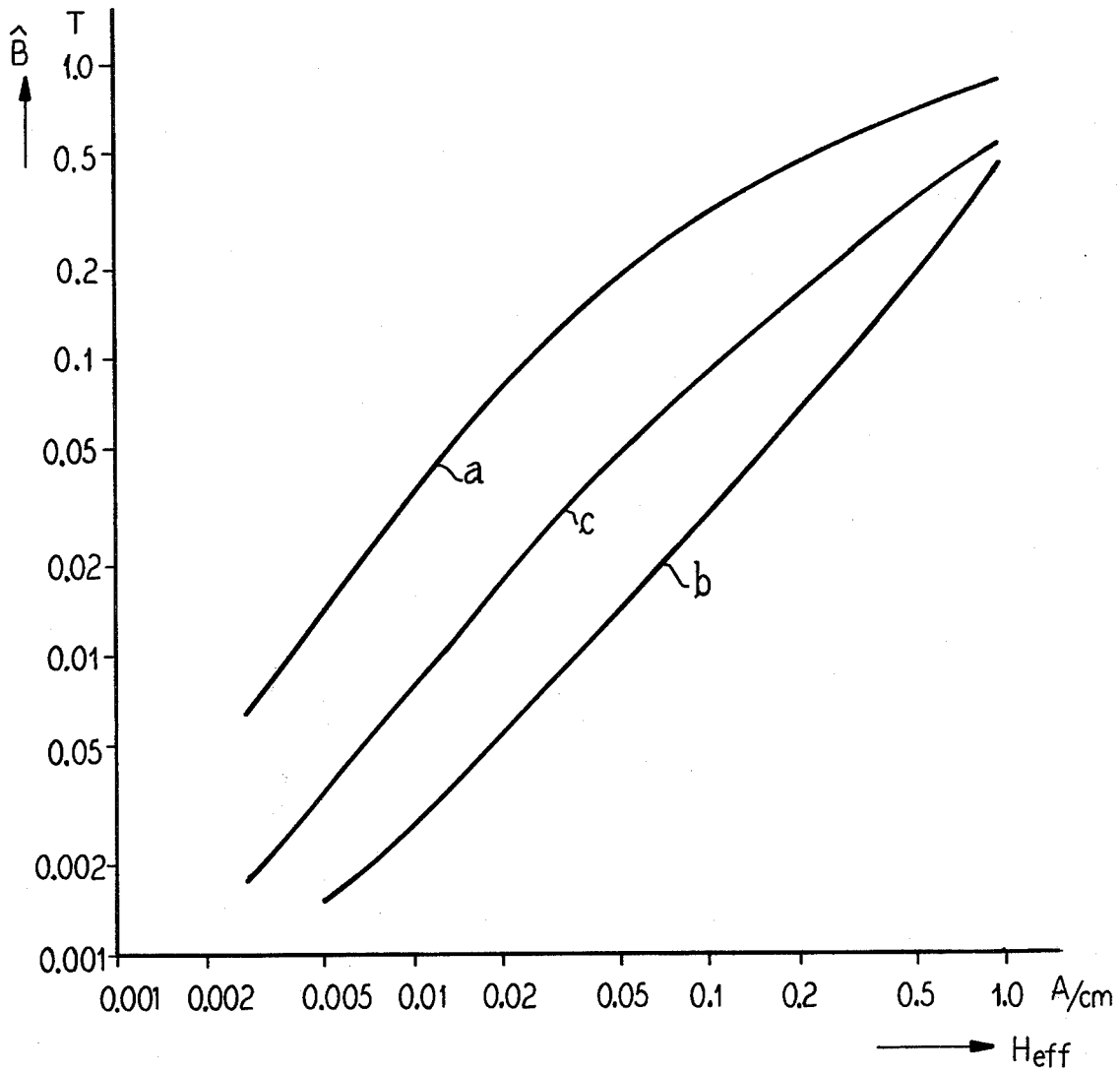
$\hat{B}$
T
1.0
0.5
0.2
0.1
0.05
0.02
0.01
0.05
0.002
0.001
a
c
b
0.001
0.002
0.005
0.01
0.02
0.05
0.1
0.2
0.5
1.0
A/cm
$H_{eff}$

REDUCING MAGNETIC HYSTERESIS LOSSES IN CORES OF THIN TAPES OF SOFT MAGNETIC AMORPHOUS METAL ALLOYS

This application is a continuation-in-part of my earlier filed U.S. application Ser. No. 881,039, filed Feb. 24, 1978, now abandoned.

BACKGROUND OF THE INVENTION

The field of this invention lies in techniques for reducing magnetic hysteresis losses in thin magnetic tapes.

It is known that amorphous metal alloys can be produced from a melt of corresponding composition by cooling the melt so rapidly that it solidifies without crystallization. By such a quenching procedure such alloys can be directly formed in the shape of a thin tape or ribbon, whose thickness, for example, can range up to several hundredths of a millimeter and whose width, for example, can range up several millimeters (compare, for example German Offenlegungschrift No. 25 00 846 and German Offenlegungsschrift No. 26 06 581).

Amorphous alloys can be distinguished from crystal alloys be means of X-ray diffraction measurements. Thus, in contrast to crystalline materials, which exhibit characteristic sharp (intense) diffraction bands, the intensity of X-ray diffraction bands exhibited by amorphous metal alloys is found to alter with the diffraction angle, only slowly as is comparable to the characteristic X-ray diffraction patterns observed in liquids or common glass. Depending upon the production (conditions), an amorphous metal alloy can be totally amorphous, or it can be comprised of a two-phase mixture of the amorphous and the crystalline states. Thus, the term "amorphous metal alloys", or equivalent as used herein, generally has reference to an alloy which is at least 50%, and preferably at least 80%, amorphous on a 100 total weight percent alloy basis.

Each amorphous metal alloy has a characteristic temperature, the so-called "crystallization temperature", such that, if the amorphous alloy is heated to, or above, this temperature, said alloy passes into its crystalline state. However, the amorphous condition is retained during thermal treatments below such crystallization temperature.

The soft-magnetic amorphous metal alloys known up to the present time are characterized by having the general composition $$M_yX_{1-y},$$

where M represents at least one of the metals iron, cobalt and nickel, and X represents at least one of the so-called glass-forming elements boron, carbon, silicon and/or phorphorus, and y is a numerical value which lies between 0.60 and 0.95. In addition to the metals M, such amorphous alloys can also contain additional metals, particularly, titanium, zirconium, vanadium, niobium, tantalum, chromium, molybdenum, tungsten, manganese, palladium, platinum, copper, silver and/or gold. In addition to the glass-forming elements X, or, optionally, even in place of such elements, such an amorphous alloy can contain the elements aluminum, gallium, indium, germanium, tin, arsenic, antimony, bismuth and/or beryllium (compare German Offenlegungsschrift No. 25 46 676, German Offenlegungsschrift No. 25 53 003, German Offenlegungsschrift No. 26 05 615 and German Offenlegungsschrift No. 26 28 362).

Soft-magnetic amorphous alloys with their respective associated magnetic properties are of great interest for technical utilization since they, as previously mentioned, can be directly produced in the shape of thin tapes. In contrast thereto, in the case of the crystalline soft-magnetic metal alloys now common in the art, a plurality of milling steps with numerous intermediate annealings are required in order to produce correspondingly thin tapes. By the term "soft magnetic" as used herein reference is had to such an alloy which is relatively easily magnetized or demagnetized.

It is known that the magnetic properties of a soft-magnetic amorphous metal alloy can be altered by means of a heat treatment at a temperature below its crystallization temperature. Thus, in the case of the members of a series of cobalt-containing soft-magnetic amorphous metal alloys, a corresponding heat treatment in conjunction with helium in a magnetic field running parallel to the longitudinal direction of the treated tape, a so-called longitudinal field, which is sufficient in order to saturate the alloy technically, leads to an increased remanence and to a decreased coercive force. A corresponding heat treatment of the members of such series of alloys in a magnetic field running vertically (or perpendicularly) to the longitudinal direction of the treated tape, and parallel to the plane of the tape, a so-called transverse field, leads to a treated tape whose magnetization varies in an approximately linear fashion with respect to the field intensity for field intensity values of nearly zero (German Offenlegungsschrift No. 25 46 676).

It was ascertained with more intensive examinations of tapes, and cylindrical cores formed thereof, the tapes consisting of the soft-magnetic amorphous alloy $Fe_{0.40}Ni_{0.40}P_{0.14}B_{0.06}$, that an annealing treatment at a temperature between the Curie temperature and the crystallization temperature for such alloy leads to a mechanical relaxation of the alloy, and that the magnetic properties of the correspondingly treated alloy depend considerably upon the conditions under which that alloy is cooled to a temperature below its Curie temperature subsequent to its annealing treatment. The annealing treatments in these known experiments were carried out in conjunction with nitrogen and in a vacuum. By annealing followed by a subsequent controlled cooling in a magnetic longitudinal field, the remanence and the remanence ratio, as is common is crystalline soft-magnetic materials, was increased in relation to non-annealed cores. In contrast thereto, but as is also common in crystalline soft-magnetic cores, the remanence and the remanence ratio in relation to non-annealed cores was decreased by means of annealing and subsequent cooling in a transverse magnetic field, so that the corresponding inductance-field intensity curves have a flatter (smoother) gradient than those of the unannealed cores, and exhibit a so-called F-characteristic due to their flat (shallow gradient) course. In an annealing treatment in conjunction with nitrogen, moreover, the coercive force and the magnetic hysteresis losses were considerably decreased in relation to the unannealed cores, whereas the corresponding effects were somewhat less salient (pronounced) in the case of the annealing in a vacuum (compare IEEE Transactions on Magnetics, Vol. Mag-11, No. 6, 1975, pages 1644 through 1649 and conference on Rapidly Quenched Metals, Vol. 1, Boston, 1975, pages 467 ff.).

By annealing in nitrogen, with one exception, the magnetic hysteresis losses in these known experiments, however, could only be decreased to values which are approximately double the magnetic hysteresis losses in tapes consisting of comparable soft magnetic alloys. Thus, for example, in an alternating magnetic field at a maximum induction of 0.1 T, and at a frequency of 10 kHz, in the most favorable instance, loss values of 18 $mW/cm^3$ equal to 2.4 W/kg were obtained, whereas the corresponding losses in tapes consisting of low-loss conventional crystalline soft-magnetic alloys only amount to approximately 1 W/kg. Only in the one case mentioned was a loss value of approximately 1.33 W/kg obtained in alternating cited magnetic field. However, the core involved has been cooled with a high cooling speed which is virtually no longer capable of being technically controlled, and, moreover, it exhibited a remanence ratio of 0.2 which no longer results in a flat (shallow) F-loop. However, for a number of technical uses, which up to now were reserved for crystalline soft-magnetic alloys, precisely a hysteresis curve in the form of an F-loop is desirable in simultaneous conjunction with magnetic hysteresis losses which are as low as possible.

BRIEF SUMMARY OF THE INVENTION

More particularly, this invention relates to a method for reducing magnetic hysteresis losses in a magnetic core formed of thin tape comprised of a soft magnetic amorphous metal alloy, whereby such a tape in the form of a magnetic core wound therefrom is first heated to a temperature above its Curie temperature, but below its crystallization temperature, for the purpose of mechanical relaxation, or tension release, and afterwards is then allowed to cool in a controlled manner to a temperature below such Curie temperature. Both the heating and the cooling are carried out in an oxidizing atmosphere.

The invention has as a primary object the further decreasing (or reducing) of magnetic hysteresis losses in soft-magnetic amorphous metal alloys beyond that heretofore realized.

Another object is to achieve such a goal by using a method of the general type above related, and simultaneously to obtain an F-characteristic in the hysteresis curve which is as flat as possible.

A surprising and unexpected feature of this invention is that such objects are achieved by conducting an annealing and a subsequent cooling of a core of thin metal alloy tape in air or other oxydizing atmosphere.

The thermal treatment sequence of annealing and controlled cooling in air leads surprisingly and unexpectedly to low magnetic hysteresis losses, and also surprisingly to low remanences and remanence ratios. To date, it has not yet been possible to completely clarify (or explain) the particular influences (or properties) of such a thermal treatment which accounts for these effects. However, in all probability, a stressing or tensioning of such a thin tape consisting of an amorphous soft magnetic alloy by means of a thin oxide layer deposited, or existing, on the tape's surface, plays a role. A corresponding effect may also be obtained with other oxidizing media.

Other and further aims, objects, purposes, advantages, uses, and the like for the present invention will be apparent to those skilled in the art from the present specification.

BRIEF DESCRIPTION OF THE DRAWING

In the accompanying FIGURE is shown a plot showing the relation between effective magnetic field intensity as abscissae versus maximum induction amplitude as ordinates for each of three cores, all similarly formed with the same soft magnetic amorphous metal alloy thin tape, all processed under the teachings of this invention, but each being subjected to different processing conditions.

DETAILED DESCRIPTION

By the term "oxidizing atmosphere" as used herein, conventional reference is had to a gaseous atmosphere in which an oxidation reaction can occur. For purposes of the present invention, such an atmosphere should comprise at least about 10% by weight of oxygen ($O_2$) with the balance up to 100 weight percent thereof being an inert gas. Suitable inert gases include, for examples, nitrogen, neon, argon, or other Group VIII gas (of the Periodic Table of the Elements), or the like. A particularly preferred oxidizing atmosphere comprises air. Another suitable oxidizing atmosphere is comprised of from about 25 to 80 weight percent oxygen with the balance up to 100 weight percent thereof on a total atmosphere weight basis being an inert gas. Another suitable oxidizing atmosphere comprises only oxygen.

The pressure at which the oxidizing atmosphere is maintained during practice of the process of the present invention can vary widely. Atmospheric pressures are particularly convenient, but super atmospheric and sub-atmospheric pressures can be employed. For example, one suitable pressure range extends from about $5\times10^4$ to $2\times10^5$ $N/m^2$.

The cooling rate utilized in the practice of the present invention can vary substantially, but is typically in the range from about 20° to 300° C. per hour. As hereinbelow indicated, particular values in this range may be more suitable for tapes composed of certain alloys, as opposed to other tapes of different alloys.

The starting tapes used in this invention are amorphous and soft magnetic, as indicated above. Commonly, such a tape has a thickness ranging from about 0.01 to 0.1 millimeters (0.03 to 0.06 mm being preferred), and has a width ranging from about 1 to 30 millimeters (1 to 20 mm being preferred).

Such starting tapes are known to the prior art, as are the methods for their manufacture. The composition of the metal alloy forming the tape can vary widely, as those skilled in the art will appreciate.

A starting tape is incorporated into a core before being processed according to this invention. By the term "magnetic core", or simply, "core", as used herein, reference is had to a conventional configuration comprised of magnetic material and incorporating a plurality of spirally or similarly wound layers of a thin tape of soft-magnetic amorphous metal alloy, as above characterized. Such an individual core configuration can have, for example, a small doughnut-like shape which is adapted for placing in a spatial relationship to current-carrying conductors, as those skilled in the art will readily appreciate. Preferably such an individual core configuration is shaped and adapted for use as a transformer core, particularly for a transformer core in a so-called medium frequency power supply. Methods for making cores are well known to the prior art.

During processing by the teachings of this invention, a tape is preferably exposed to, or maintained in, during the cooling step, a magnetic field at least sufficient to magnetize such tape nearly to its saturation point. By the term "saturation point", or equivalent, reference is had to the condition in which, after a magnetic field strength becomes sufficiently large, further increase in the magnetic field strength produces no additional magnetization in a magnetic material. In this invention, the field is preferably applied either longitudinally or transversely relative to a given tape (preferably longitudinally).

Members of preferred class of starting tapes consist of an alloy characterized by the formula $$Fe_wNi_xP_yB_z$$

where w ranges from about 20 to 80 atomic percent,
x ranges from about 0 to 60 atomic percent,
y ranges from about 0 to 20 atomic percent, and
z ranges from about 0 to 20 atomic percent, and
y+z ranges from 15 to 30 atomic percent, and in any given such metal alloy, the sum total of w, x, y, and z is 100 atomic percent.

Within this class of starting tapes, a particularly preferred member is an alloy of the formula $$Fe_{0.40}Ni_{0.40}P_{0.14}B_{0.06}$$

where the subscript values are expressed in hundredths of atomic percents.

A tape of such class, following the teachings of this invention, is formed into a core and then heated to a temperature ranging from about 280° to 350° C. for a time of at least about 0.5 to 2 hours. Also, following such teachings, such a so heated shaped tape is cooled preferably to a temperature below about 200° C. at a cooling rate of from about 100° to 250° per hour. The heating and the cooling take place in an oxidizing atmosphere.

In view of the favorable obtainable values regarding remanence, remanence ratio, and hysteresis losses, it has been proven to be particularly advantageous to anneal a magnetic core formed of a soft magnetic, amorphous tape which consists, for example, of the particular composition $Fe_{0.40}Ni_{0.40}P_{0.14}B_{0.06}$ for at least approximately 0.5 through 2 hours at a temperature of between approximately 280° and 350° C., and then to cool it down to a temperature of 200° C. or less in a controlled manner, such as above indicated.

Using temperatures of between about 280° and 350° C., and while employing the cited minimum annealing times of approximately 0.5 through 2 hours, a complete mechanical tension release of the tapes can be obtained. The longer minimum annealing times are to be used for the lower temperatures, and, conversely, the shorter times for the higher temperatures. Furthermore, the temperatures lie above the Curie temperature of this type of alloy which temperature is approximately 230° C., and below the crystallization temperature of the alloy which temperature is about 360° C. In the case of the alloy mentioned, a cooling speed of approximately 100 to 250° C. per hour has been proven to be particularly advantageous for the controlled cooling in view of the magnetic parametrics desired.

In the case of annealing and cooling in air, it is furthermore of considerable importance whether the cooling proceeds without a magnetic field or in a magnetic field. If the annealing and cooling takes place in the absence of a magnetic field, a very small remanence ratio and very low hysteresis losses are obtained. An additional decrease of the losses with a somewhat increased remanence ratio can be obtained in that a core wound from such tape is magnetized nearly to the saturation point in a magnetic field running in the longitudinal direction of the tape during the controlled cooling.

Accordingly, the cooling-off in a longitudinal field is particularly advantageous if the smallest possible loss values are to be obtained. By magnetizing a tape of a core during the cooling-off process nearly to its saturation point in a transverse magnetic field, one can obtain magnetic characteristic values for a core which lie between the values obtained during cooling in the longitudinal field and the values obtained during cooling in the absence of a magnetic field. However, magnetic hysteresis losses are somewhat higher than in the other types of magnetization.

In any case, magnetization nearly to the saturation point must proceed during the controlled cooling-off process from a temperature above the Curie temperature to a temperature below the Curie temperature. However, for purely practical reasons, one will, in most instances, apply the corresponding magnetic field already during the heating for the purpose of a mechanical relaxation. It is to be understood herein, that the term "magnetization nearly to the saturation point" has reference to a magnetization of more than 60% of the saturation point. It is advantageous to come as close as possible to saturation, as those skilled in the art will appreciate.

The tape cores processed in accordance with the method of this invention are particularly well suited for transformer cores in so-called medium frequency power supplies, for example, a frequency of 20 kHz. In addition to the low magnetic hysteresis losses which are a requirement for such a utilization, a flat F-characteristic of the hysteresis curve of the transformer cores is an essential factor in a number of circuit applications for such power supplies. Medium frequency power supplies, in relation to power supplies with a frequency of, for example, 50 Hz, possess the advantage that the respective transformers can be constructed considerably smaller, and, in addition, the often interfering humming at 50 Hz is eliminated. Medium frequency power supplies are often employed, for example, in data processing equipment, office computers, cash registers and teletypewriters. The inventively treated tape cores consisting of amorphous soft-magentic alloy tapes are also suitable for utilization in the case of unipolar drives where a flat slope of the hysteresis curve is also of importance.

EMBODIMENTS

With the aid of the accompanying FIGURE illustrating the induction-field intensity curves of inventively treated ring tape cores, and with the aid of sample embodiments below, the invention is more closely explained.

The present invention is further illustrated by reference to the following examples. Those skilled in the art will appreciate that other and further embodiments are obvious and within the spirit and scope of this invention from the teachings of these present examples taken with the accompanying specification.

EXAMPLE 1

Several ring tape cores of 20 mm exterior and 10 mm interior diameter were produced from an approximately 2 mm wide and 0.05 mm thick tape consisting of a soft-magnetic amorphous alloy of the composition $Fe_{0.40}Ni_{0.40}P_{0.14}B_{0.06}$. The individual tape windings were insulated from one another by means of magnesium oxide powder. The wound cores, each respectively consisting of 70 to 80 windings, were inserted into suitable protective aluminum troughs. The cores in the protective troughs were then subjected to a 30 minute relaxation annealing at a temperature of approximately 325° C., which lies between the Curie temperature of the alloy of approximately 230° C. and the alloy crystallization temperature of approximately 360° C. Subsequent to the annealing, the cores were allowed to cool off in a controlled manner at a cooling rate of approximately 200° C. per hour to a temperature below the Curie temperature; in the present case, to a temperature of approximately 100° C. Additional cooling to ambient temperatures proceeded in an uncontrolled manner.

The annealing and subsequent controlled cooling-off proceeded in air under different conditions. A group of the cores was annealed and cooled in a magnetic field running in peripheral direction of the individual core; i.e., in a magnetic field running parallel to the longitudinal direction of the wound tape, in a so-called longitudinal field, which was produced by means of a winding secured to the core and which magnetized the amorphous alloy near to its saturation value with a field intensity of 16 A/cm.

EXAMPLE 2

Another group of the cores was annealed and cooled in a magnetic field directed vertically to the longitudinal direction of the tape, parallel to the winding axis of the core, a so-called transverse field. For this purpose, the cores were brought into the field of a 10 cm-long rod magnet consisting of AlNiCo 26/6 having a cross sectional area of 4 by 4 $cm^2$.

EXAMPLE 3

An additional group of the cores was annealed and cooled in the absence of a magnetic field.

EXAMPLE 4

For comparison, an additional group of cores were subjected to a corresponding treatment in which, however, the annealing and the subsequent controlled cooling proceeded under hydrogen.

EXAMPLE 5

In the cores thus treated, induction-field intensity curves at 50 Hz were then measured with a vector measuring device. From these curves, the relative alternating field permeabilities $\mu_4$, i.e., the permeability at a magnetic field intensity of 4 mA/cm, and $\mu_{max}$, i.e., the maximum permeability, was determined. Moreover, the coercive force $H_c$ and the remanence $B_r$ were statically determined. From the latter and from the saturation induction $B_s$, which amounted to approximately 0.8 T in the alloy utilized, the ratio of the remanence $B_r$ to the saturation induction $B_s$, was determined, the so-called remanence ratio $B_r/B_s$, which is a good measure of the slope of the hysteresis curve and thus of the F-characteristic of of the hysteresis loop. Moreover, the magnetic hysteresis losses $P_{Fe}$ in an alternating magnetic field having maximum induction of 0.1 T and a frequency of 10 kHz and in an alternating magnetic field having a maximum induction of 0.2 T and a frequency of 20 kHz were measured.

The test results were compiled in the following Table I together with the values measured on an unannealed ring tape core consisting of the same amorphous soft magnetic alloy.

TABLE I

| Annealing Conditions | $\mu_4$ | $\mu_{max}$ | $H_c$ mA/cm | $B_r/B_s$ | $B_r$ T | $P_{Fe}$(o,1 T;10 kHz) W/kg | $P_{Fe}$(o,2 T;20 kHz) W/kg |
|---|---|---|---|---|---|---|---|
| Air, longitudinal field | 13 100 | 25 300 | 17,9 | 0,10 | 0,080 | 0,95 | 10,7 |
| Air, without magnetic field | 1 600 | 2 300 | 60,0 | 0,013 | 0,010 | 1,1 | 13,2 |
| Air, transverse field | 3 650 | 5 400 | 29,0 | 0,034 | 0,027 | 2,0 | 16,0 |
| $H_2$, Longitudinal field | 42 500 | 281 000 | 6,9 | 0,92 | 0,736 | 3,7 | 34,0 |
| $H_2$, without magnetic field | 5 500 | 56 000 | 22,0 | 0,470 | 0,376 | 3,5 | 31,0 |
| $H_2$, transverse field | 5 000 | 24 500 | 14,0 | 0,144 | 0,115 | 2,4 | 22,5 |
| unannealed (non-) | 150 | 25 900 | 65,0 | 0,419 | 0,355 | 14,5 | 91,0 |

The induction-field intensity curves measured at 50 Hz using the ring tape cores annealed and cooled in air are illustrated in the FIGURE. The effective magnetic field intensity $H_{eff}$ is plotted in A/cm on the abscissa in a logarithmic scale, and the respective maximum amplitude B of the induction is also plotted in T in a logarithmic scale on the ordinate. The curve a was measured on a core annealed and cooled in a longitudinal field; curve b was measured on a core annealed and cooled in the absence of a magnetic field; and the curve c was measured on a core annealed and cooled in a transverse field. The curves illustrate an approximately linear increase in the induction with the field intensity. They have a very flat (or shallow) slope and thus show a marked or pronounced F-characteristic.

In a comparison of the values compiled in the Table I, it is particularly noticeable that the remanence and the remanence ratio of the cores annealed and cooled in air is extremely small in relation to the non-annealed core, and to the cores annealed and cooled under hydrogen. The decrease of both values is particularly remarkable in the core subjected to the annealing treatment (process) in the longitudinal field under air in relation to the values of the unannealed core. Indeed, the remanence and remanence ratio is normally increased by annealing with controlled cooling in the longitudinal field, as occurs, for example, in the case of the core which is annealed and cooled in the longitudinal field under hydrogen.

The Table I furthermore illustrates that the magnetic (or hysteresis) losses caused by annealing and subsequent controlled cooling in air are reduced as compared with those of the unannealed core to an extent far exceeding the reduction obtained with an annealing treatment under hydrogen. The losses are particularly low in cores which are annealed and cooled without magnetic field and in the longitudinal field. In cores of tapes with a thickness of 0.05 mm consisting of conventional crystalline permalloys (approximately 76.5 percent by weight nickel, 4.5 percent by weight copper, 3 through 3.5 percent by weight molybdenum, and the balance up to 100 weight percent being iron), values in magnetic hysteresis losses of 10 through 12 W/kg are obtained at 0.2 T and 20 kHz. Thus, the cores consisting of the amorphous soft magnetic alloy, which are annealed and cooled under air in a longitudinal field, or without a magnetic field, are completely equivalent to conventional permalloys in regard to their loss values.

The permeability of $\mu_4$ is considerably increased by the annealing and cooling in air in relation to the unannealed core, although less so than through annealing with hydrogen. In contrast thereto, the maximum permeability $\mu_{max}$ in relation to the unannealed core, during annealing and cooling under air in a longitudinal field drops slightly, and during annealing and cooling under air without a magnetic field, or in the transverse field, it decreases approximately by a factor of 5 to 10. The decrease in the coercive force is less pronounced during annealing and cooling in air than during annealing and cooling in hydrogen. The magnetic (or hysteresis) losses at 0.1 T and 10 kHz of the cores annealed and cooled in air, having a simultaneously very low remanence and low remanence ratio, also lie considerably below those losses of the already mentioned, known cores annealed and cooled under nitrogen.

Corresponding reductions in the magnetic hysteresis losses with a simultaneous (shallow-slope) or flat F-characteristic of the hysteresis curve can also be obtained in other soft magnetic, amorphous metal alloys with the aid of the inventive technique. Particularly advantageous effects are to be expected with alloys whose magneto-striction is not zero.

EXAMPLE 6

In order to examine the influence of the cooling rate (speed), two ring tape cores of the already mentioned type, subsequent to a 30-minute relaxation (or tension release) annealing at approximately 325° C. in a magnetic longitudinal field were allowed to cool-off at a cooling-off speed at 1200° C. per hour, which, however, can only be obtained, or controlled, respectively, for an applied technical use with great difficulty and at a cooling speed of 10° C. per hour.

Indeed, the remanence and the remanence ratio were thereby even further decreased to approximately 30 and 45% by comparison to the cooling in the longitudinal field at a cooling velocity of 200° C. per hour, and thus an even flatter hysteresis curve was obtained in each instance. However, the relative permeabilities $\mu_4$ and $\mu_{max}$, at a cooling velocity of 1200° C. per hours, dropped to approximately 50% and 30% respectively, and at a cooling velocity of 10° C. per hour said permeabilities dropped to approximately 6% and 7%, respectively, of the values obtained after cooling at 200° C. per hour. The magnetic hysteresis losses after cooling at 1200° C. per hour increased by approximately 30 percent, and after cooling at 10° C. per hour, said losses increased further in relation to the losses incurred after cooling at 200° C. per hour. The range of the average cooling rate of approximately 100° to 250° C. per hour is therefore particularly advantageous for the cooling-off process in the longitudinal field in air due to the relatively high permeabilities obtainable and the low magnetic (or hysteresis) losses with a simulataneously already very flat slope (or gradient) of the hysteresis curves.

EXAMPLE 7

Magnetic cores are made using the procedures of Example 1 and the product cores are subjected to a series of annealings followed by controlled coolings using the technique of Example 1 to 4. Specifically, the annealing temperature in each case was about 400° C. Referring to Table II, the first three alloys cited therein were each annealed for about one hour, and each of the remaining four was annealed for about four hours. The cooling velocity was about 200° C. per hour.

A comparison of the annealings in air with those under hydrogen as shown in Table II shows that by means of air annealing for one thing, the magnetic reversal losses $P_{fe}$ are significantly reduced, and, for another thing, also reduced $B_r/B_s$ values result. Thus, flatter curving (running) hysteresis loops result. Measured values of non-annealed cores are not contained in Table II; experience has shown that cores of this sort in the unannealed state (corresponding to the example given herein) display such high magnetic reversal losses that they do not come into question for practical employment.

In column 1 of Table II the composition, the Curie temperature $T_c$ and the crystallization temperature $T_k$ of the respective alloys are shown. Column 7 contains the respective saturation induction $B_s$ in Tesla. The other columns correspond to the respective columns of Table I with the exception that $\mu_4$ and $\mu_{max}$ have been statically (not dynamically) measured for the first two alloys cited in Table II.

TABLE II

| Alloy | Annealing Conditions | $\mu_4$ | $\mu_{max}$ | $H_c$ mA/cm | $B_r/B_s$ | $B_s$ T | $P_{Fe}$(0,2T;20 kHz) W/kg |
|---|---|---|---|---|---|---|---|
| $Fe_{0,65}Ni_{0,15}Mo_{0,02}Si_{0,06}B_{0,12}$ | Air, Without Field | | | 68 | 0,35 | 1,2 | 14 |
| $T_c$ = 375° C., $T_k$ = 485° C. | $H_2$ Longitudinal Field | 300 | 420 000 | 14 | 0,9 | 1,2 | 45 |
| $Fe_{0,65}Ni_{0,15}Mo_{0,02}B_{0,18}$ | Air, Without Field | | | 141 | 0,11 | 1,3 | 11 |
| $T_c \approx$ 400° C., $T_k$ = 450° C. | $H_2$ Longitudinal | 9 000 | 370 000 | 20 | 0,9 | 1,3 | 28 |
| $Fe_{0,81}Si_{0,035}B_{0,0135}C_{0,02}$ | Air, Without Field | | | 172 | 0,10 | 1,6 | 7 |
| $T_c$ = 370° C., $T_k$ = 480° C. | $H_2$ Longitudinal Field | | 140 000 | 40 | 0,85 | 1,6 | 25 |
| $Fe_{0,40}Ni_{0,38}Mo_{0,04}B_{0,18}$ | Air Longitudinal Field | 15 000 | 100 000 | 13,5 | 0,4 | 0,84 | 11,5 |
| $T_c$ = 315° C., $T_k$ = 420° C. | Air Without Field | 20 000 | 60 000 | 12 | 0,3 | 0,84 | 8,5 |
| | $H_2$, Longitudinal Field | 60 000 | 250 000 | 6 | 0,8 | 0,84 | >25 |
| $Fe_{0,40}Ni_{0,38}Mo_{0,04}Si_{0,02}B_{0,16}$ | Air Without Field | | | 12 | 0,45 | 0,80 | 9 |
| $T_c$ = 300° C., $T_k$ = 445° C. | $H_2$ Longitudinal | 80 000 | 280 000 | 5,5 | 0,75 | 0,80 | >25 |
| $Fe_{0,40}Ni_{0,38}Mo_{0,04}Si_{0,04}B_{0,14}$ | Air Longitudinal | 15 000 | 120 000 | 10,7 | 0,5 | 0,80 | 10,5 |
| $T_c$ = 290° C., $T_k$ = 460° C. | Air Without Field | 13 000 | 80 000 | 12 | 0,4 | 0,80 | 9,5 |
| | $H_2$ Longitudinal | 80 000 | 280 000 | 5,5 | 0,75 | 0,80 | >25 |
| $Fe_{0,40}Ni_{0,38}Mo_{0,04}Si_{0,06}B_{0,12}$ | Air Longitudinal | | | 11 | 0,35 | 0,80 | 9,5 |
| $T_c$ = 270° C., $T_k$ = 465° C. | Air Without Field | 20 000 | 64 000 | 13 | 0,20 | 0,80 | 8,5 |

TABLE II-continued

| Alloy | Annealing Conditions | $\mu_4$ | $\mu_{max}$ | $H_c$ mA/cm | $B_r/B_s$ | $B_s$ T | $P_{Fe}$(0,2T;20 kHz) W/kg |
|---|---|---|---|---|---|---|---|
| | $H_2$, Longitudinal | 50 000 | 250 000 | 6,5 | 0,80 | 0,80 | >25 |

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth in the hereto-appended claims.

We claim:

1. In an improved method for reducing magnetic hysteresis losses in a starting magnetic core formed of a thin tape consisting of soft-magnetic, amorphous metal alloy, the steps comprising (a) heating said core to a temperature in the range above the Curie temperature and below the crystallization temperature of said alloy for a time sufficient to relax mechanical tensions in said tape, and then (b) cooling the so-heated said core to a temperature below its Curie temperature at a controlled rate, said heating and said cooling being conducted in an oxidizing atmosphere.

2. The method of claim 1 wherein said tape has a thickness ranging from about 0.01 to 0.1 millimeters and a width ranging from about 1 to 30 millimeters.

3. In an improved method for reducing magnetic hysteresis losses in a starting magnetic core formed of a thin tape consisting of a soft-magnetic, amorphous metal alloy, having the composition:

$$Fe_{0.40}Ni_{0.40}P_{0.14}B_{0.06},$$

the steps comprising (a) heating said core to a temperature in the range above the Curie temperature and below the crystallization temperature of said alloy, for a time sufficient to relax mechanical tensions in said tape, and then (b) cooling the so-heated said core to a temperature below its Curie temperature at a controlled rate, said heating and said cooling being conducted in an oxidizing atmosphere.

4. The method of claim 1 wherein, during said cooling, said core is maintained in a magnetic field at least sufficient to magnetize said tape nearly to its saturation point.

5. The method of claim 4 wherein said field is applied in a longitudinal direction relative to said core.

6. The method of claim 1 wherein said cooling rate ranges from about 20° to 300° C. per hour.

7. The method of claim 2 wherein said tape has a thickness ranging from about 0.03 to 0.06 millimeters and a width ranging from about 1 to 20 millimeters.

8. The method of claim 7 wherein said metal alloy is characterized by having the formula $$Fe_wNi_xP_yB_z$$

where w ranges from about 20 to 80 atomic percent x ranges from about 0 to 60 atomic percent, y ranges from about 0 to 20 atomic percent, and z ranges from about 0 to 20 atomic percent, and y+z ranges from 15 to 30 atomic percent and, in any given such metal alloy, the sum total of w, x, y and z is 100 atomic percent.

9. The method of claim 1 wherein said oxidizing atmosphere comprises air.

10. A method for reducing magnetic hysteresis losses in a starting magnetic core formed of a thin tape consisting of soft magnetic amorphous metal alloy, said tape having a thickness ranging from about 0.01 to 0.1 millimeters and a width ranging from about 1 to 30 millimeters, said metal alloy being characterized by having the formula $$Fe_wNi_xP_yB_z$$

where w ranges from about 20 to 80 atomic percent, x ranges from about 0 to 60 atomic percent, y ranges from about 0 to 20 atomic percent, and z ranges from about 0 to 20 atomic percent, and y+z ranges from 15 to 30 atomic percent and, in any given such metal alloy, the sum total of w, x, y, and z is 100 atomic percent, said method comprising the steps of (A) heating said core in an oxidizing atmosphere to a temperature ranging from about 280° to 350° C. for a time of at least about 0.5 to 2 hours, and then (B) cooling said to heated core to a temperature below about 200° C. at a cooling rate of from about 100° to about 250° C. per hour in an oxidizing atmosphere.

11. The method of claim 10 wherein, at least during said cooling, said core is maintained in a magnetic field which is at least sufficient to magnetize said core nearly to its saturation point.

12. The method of claim 11 wherein said field is applied in transverse direction relative to said tape.

13. The method of claim 11 wherein said field is applied in a longitudinal direction relative to said tape.

14. The method of claim 10 wherein said oxidizing atmosphere comprises air.

15. The method of claim 10 wherein said oxidizing atmosphere comprises from about 25 to 80 percent oxygen with the balance up to 100 percent on a total atmosphere weight basis being an inert gas.

16. The method of claim 10 wherein said oxidizing atmosphere comprises oxygen.

17. A method for reducing magnetic hysteresis losses in a starting magnetic core formed of a thin tape consisting of a soft magnetic amorphous metal alloy, said tape having a thickness ranging from about 0.01 to 0.1 millimeters and a width ranging from about 1 to 30 millimeters, said alloy comprising $$Fe_{0.40}Ni_{0.40}P_{0.14}B_{0.06}$$

said method comprising the steps of (A) heating said core in an oxidizing atmosphere to a temperature ranging from about 280° to 350° C. for a time of at least about 0.5 to 2 hours, and then (B) cooling said to heated core to a temperature below about 200° C. at a cooling rate of from about 100° to 250° C. per hour in an oxidizing atmosphere.

18. The method of claim 10 wherein said oxidizing atmosphere is maintained at atmospheric pressure.

19. The method of claim 10 wherein said oxidizing atmosphere is maintained at a pressure of from about $5.10^4$ to $2.10^5$ $N/m^2$.

20. A magnetic core produced by the process of claim 1, said core having lower magnetic hysteresis losses, lower remanences, and lower remanence ratios than said starting magnetic core.

21. A magnetic core produced by the process of claim 10, said core having lower magnetic hysteresis losses, lower remanences, and lower remanence ratios than said starting magnetic core.

22. The process of claim 1 wherein said oxidizing atmosphere comprises at least 10 weight percent oxygen with the balance up to 100 weight percent being inert gas.

23. The process of claim 10 wherein said oxidizing atmosphere comprises at least 10 weight percent oxygen with the balance up to 100 weight percent being inert gas.

* * * * *